US011322854B2

(12) United States Patent
Ko et al.

(10) Patent No.: US 11,322,854 B2
(45) Date of Patent: May 3, 2022

(54) ANTENNA MODULE COMPRISING REFLECTOR, AND ELECTRONIC DEVICE COMPRISING SAME

(71) Applicant: Samsung Electronics Co., Ltd., Suwon-si (KR)

(72) Inventors: Seungtae Ko, Suwon-si (KR); Youngju Lee, Suwon-si (KR); Jungsuek Oh, Incheon (KR); Inseop Yoon, Incheon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/965,424

(22) PCT Filed: Jan. 31, 2019

(86) PCT No.: PCT/KR2019/001346
§ 371 (c)(1),
(2) Date: Jul. 28, 2020

(87) PCT Pub. No.: WO2019/151796
PCT Pub. Date: Aug. 8, 2019

(65) Prior Publication Data

US 2021/0083398 A1 Mar. 18, 2021

(30) Foreign Application Priority Data

Feb. 2, 2018 (KR) ..... 10-2018-0013355

(51) Int. Cl.
*H01Q 19/18* (2006.01)
*H01Q 1/42* (2006.01)
(Continued)

(52) U.S. Cl.
CPC ..... *H01Q 19/18* (2013.01); *H01Q 1/42* (2013.01); *H01Q 21/065* (2013.01); *H01Q 1/241* (2013.01)

(58) Field of Classification Search
None
See application file for complete search history.

(56) References Cited

U.S. PATENT DOCUMENTS 4,347,517 A * 8/1982 Kaloi ..... H01Q 9/0414 343/700 MS
5,581,267 A 12/1996 Matsui et al.
(Continued)

FOREIGN PATENT DOCUMENTS

CN 101436714 A 5/2009
CN 104485520 A 4/2015
(Continued)

OTHER PUBLICATIONS

Zhen-Guo Liu: "Fabry-Perot Resonator Antenna", Journal of Infrared, Millimeter and Terahertz Waves, Dec. 22, 2009 (Dec. 22, 2009), XP055509473, US ISSN: 1866-6892, 001:10.1 007/s1 0762-009-9605-4.
(Continued)

*Primary Examiner* — Daniel Munoz
(74) *Attorney, Agent, or Firm* — Jefferson IP Law, LLP

(57) ABSTRACT

The present invention relates to: a communication technique for merging, with IoT technology, a 5G communication system for supporting a data transmission rate higher than that of a 4G system; and a system therefor. The present invention provides an antenna module comprising: an antenna array for radiating beams through a top surface thereof; a dielectric disposed to be spaced apart from the top surface of the antenna array by a first preset length; a first reflector comprising a metallic material, and disposed to be spaced apart from the bottom surface of the dielectric by a
(Continued)

second preset length; and a second reflector comprising a metallic material and disposed in the partial region of the bottom surface, of the dielectric, which faces the top surface of the antenna array.

13 Claims, 11 Drawing Sheets

(51) Int. Cl.
*H01Q 21/06* (2006.01)
*H01Q 1/24* (2006.01)

(56) References Cited

U.S. PATENT DOCUMENTS

| | | | | |
|---|---|---|---|---|
| 6,061,027 | A * | 5/2000 | Legay | H01Q 9/0414 343/700 MS |
| 7,548,217 | B2 | 6/2009 | Chang | |
| 2004/0189529 | A1 | 9/2004 | Jecko et al. | |
| 2007/0176846 | A1 | 8/2007 | Vazquez et al. | |
| 2008/0055188 | A1 | 3/2008 | Lynch | |
| 2011/0163930 | A1* | 7/2011 | De Lustrac | H01Q 15/148 343/777 |
| 2012/0249388 | A1* | 10/2012 | Hansen | H01Q 1/243 343/753 |
| 2017/0201014 | A1 | 7/2017 | Lee et al. | |
| 2017/0373399 | A1 | 12/2017 | Lee et al. | |

FOREIGN PATENT DOCUMENTS

| | | | |
|---|---|---|---|
| FR | 3030903 | A1 | 6/2016 |
| KR | 10-2010-0045824 | A | 5/2010 |
| KR | 10-2016-0024271 | A | 3/2016 |
| KR | 10-2017-0082799 | A | 7/2017 |
| KR | 10-1803196 | B1 | 11/2017 |

OTHER PUBLICATIONS

Chinese Office Action dated Jan. 27, 2021, issued in Chinese Application No. 201980011209.9.
Extended European Search Report dated Feb. 17, 2021, issued in European Application No. 19748210.2-1205.
Hong Wen, et al., "A Fabry-Perot Resonant Cavity Antenna based on a non-uniform design with High Aperture Efficiency", Oct. 16, 2017.
Chinese Office Action dated Jul. 9, 2021, issued in Chinese Application No. 201980011209.9.
Korean Office Action dated Jul. 31, 2021, issued in Korean Application No. 10-2018-0013355.

* cited by examiner

ANTENNA MODULE COMPRISING REFLECTOR, AND ELECTRONIC DEVICE COMPRISING SAME

TECHNICAL FIELD

The disclosure relates to an antenna module used in a next generation communication technology and to an electronic device including the same.

BACKGROUND ART

In order to satisfy the increasing demands of radio data traffic after the commercialization of a 4G communication system, efforts have been made to develop an advanced 5G communication system or a pre-5G communication system. For this reason, the 5G communication system or the pre-5G communication system is also referred to as a beyond-4G network communication system or a post-LTE system. In order to accomplish a higher data transfer rate, the implementation of the 5G communication system in a super-high frequency (mmWave) band (e.g., about a 60 GHz band) is being considered. Also, in order to obviate a propagation loss of a radio wave and increase a delivery distance of a radio wave in the super-high frequency band, discussions for the 5G communication system are underway about various techniques such as a beamforming, a massive MIMO, a full dimensional MIMO (FD-MIMO), an array antenna, an analog beam-forming, and a large scale antenna. Additionally, for an improvement in network of the 5G communication system, technical developments are being made in an advanced small cell, a cloud radio access network (cloud RAN), an ultra-dense network, a device to device (D2D) communication, a wireless backhaul, a moving network, a cooperative communication, coordinated multi-points (CoMP), a reception-end interference cancellation, and the like. Also, in the 5G communication system, a hybrid FSK and QAM modulation (FQAM) and a sliding window superposition coding (SWSC) are developed as advanced coding modulation (ACM) schemes, and a filter bank multi carrier (FBMC), a non-orthogonal multiple access (NOMA), and a sparse code multiple access (SCMA) are also developed as advanced access techniques.

Meanwhile, the Internet, which is a human centered connectivity network where humans generate and consume information, is now evolving to the Internet of things (IoT) where distributed entities, such as things, exchange and process information without human intervention. Further, the Internet of everything (IoE), which is a combination of IoT technology and big data processing technology through connection with a cloud server, has emerged. As technology elements, such as sensing technology, wired/wireless communication and network infrastructure, service interface technology, and security technology, have been demanded for IoT implementation, a sensor network, machine-to-machine (M2M) communication, machine type communication (MTC), and so forth have been recently researched. Such an IoT environment may provide intelligent Internet technology services that create a new value to human life by collecting and analyzing data generated among connected things. The IoT may be applied to a variety of fields including smart home, smart building, smart city, smart car or connected car, smart grid, health care, smart appliances, advanced medical service, etc. through convergence and combination between existing information technology (IT) and various industrial applications.

In line with this, various attempts have been made to apply the 5G communication system to the IoT network. For example, technologies such as a sensor network, machine type communication (MTC), and machine-to-machine (M2M) communication are being implemented on the basis of 5G communication technologies such as beamforming, MIMO, and an array antenna. The use of a cloud radio access network (cloud RAN) for big data processing technology is one example of convergence between the 5G technology and the IoT technology.

DISCLOSURE OF INVENTION

Technical Problem

A next generation communication system may use a super-high frequency (mmWave) band. In the super-high frequency band, a gain value of an antenna may be degraded due to path loss of radio waves. In order to prevent this, various devices such as a lens may be combined with the antenna. However, improving the gain value of the antenna through the lens requires a separation distance greater than a specific distance between the antenna and the lens.

On the other hand, an electronic device to which the next generation communication system is applied tends to have a gradually decreased size. Thus, there may be a case in which the separation distance between the antenna and the lens is not sufficiently secured in the electronic device. This may cause a problem that the gain value of the antenna significantly decreases.

Solution to Problem

The disclosure provides an antenna module that includes an antenna array radiating a beam through a top surface thereof, a dielectric disposed to be spaced apart from the top surface of the antenna array by a first predetermined length, a first reflector including a metallic material and disposed to be spaced apart from a bottom surface of the dielectric by a second predetermined length, and a second reflector including a metallic material and disposed in a partial region of the bottom surface of the dielectric, which faces the top surface of the antenna array.

The dielectric may change a phase of a beam incident through the bottom surface thereof and radiate the beam through a top surface thereof.

The first reflector may be disposed to surround the antenna array on a horizontal plane on which the antenna array is disposed.

The first length may be smaller than or equal to the second length.

The second reflector may have a shape of a grid, and grid patterns constituting the grid may have different sizes.

The size of each grid pattern may increase as each grid pattern is further away from a central axis of the antenna array.

The second reflector may include a plurality of unit reflectors having a predetermined shape, and the plurality of unit reflectors may be periodically disposed on the bottom surface of the dielectric.

The predetermined shape may include at least one of a square shape, a circular shape, a square ring shape, or a cross shape.

The second reflector may be composed of a plurality of layers.

A housing formed to surround the antenna module may be further comprised, and the dielectric and the second reflector may be disposed on one surface of the housing along an outer periphery of the housing.

The disclosure provides an electronic device including an antenna module, and the antenna module may include an antenna array radiating a beam through a top surface thereof, a dielectric disposed to be spaced apart from the top surface of the antenna array by a first predetermined length, a first reflector including a metallic material and disposed to be spaced apart from a bottom surface of the dielectric by a second predetermined length, and a second reflector including a metallic material and disposed in a partial region of the bottom surface of the dielectric, which faces the top surface of the antenna array.

The dielectric may change a phase of a beam incident through the bottom surface thereof and radiate the beam through a top surface thereof.

The first reflector may be disposed to surround the antenna array on a horizontal plane on which the antenna array is disposed.

The first length may be smaller than or equal to the second length.

The second reflector may have a shape of a grid, and grid patterns constituting the grid may have different sizes.

The size of each grid pattern may increase as each grid pattern is further away from a central axis of the antenna array.

The second reflector may include a plurality of unit reflectors having a predetermined shape, and the plurality of unit reflectors may be periodically disposed on the bottom surface of the dielectric.

The predetermined shape may include at least one of a square shape, a circular shape, a square ring shape, or a cross shape.

The second reflector may be composed of a plurality of layers.

A housing formed to surround the antenna module may be further comprised, and the dielectric and the second reflector may be disposed on one surface of the housing along an outer periphery of the housing.

Advantageous Effects of Invention

According to an embodiment of the disclosure, even if a separation distance between an antenna array and an insulator (or lens) is close, it is possible to maintain a gain value of an antenna module through a reflector disposed around the antenna array.

In addition, the separation distance between the antenna array and the insulator can be reduced through a structure disclosed herein, so that it is possible to reduce sizes of an antenna module and an electronic device including the antenna module.

MODE FOR THE INVENTION

Figure 1:
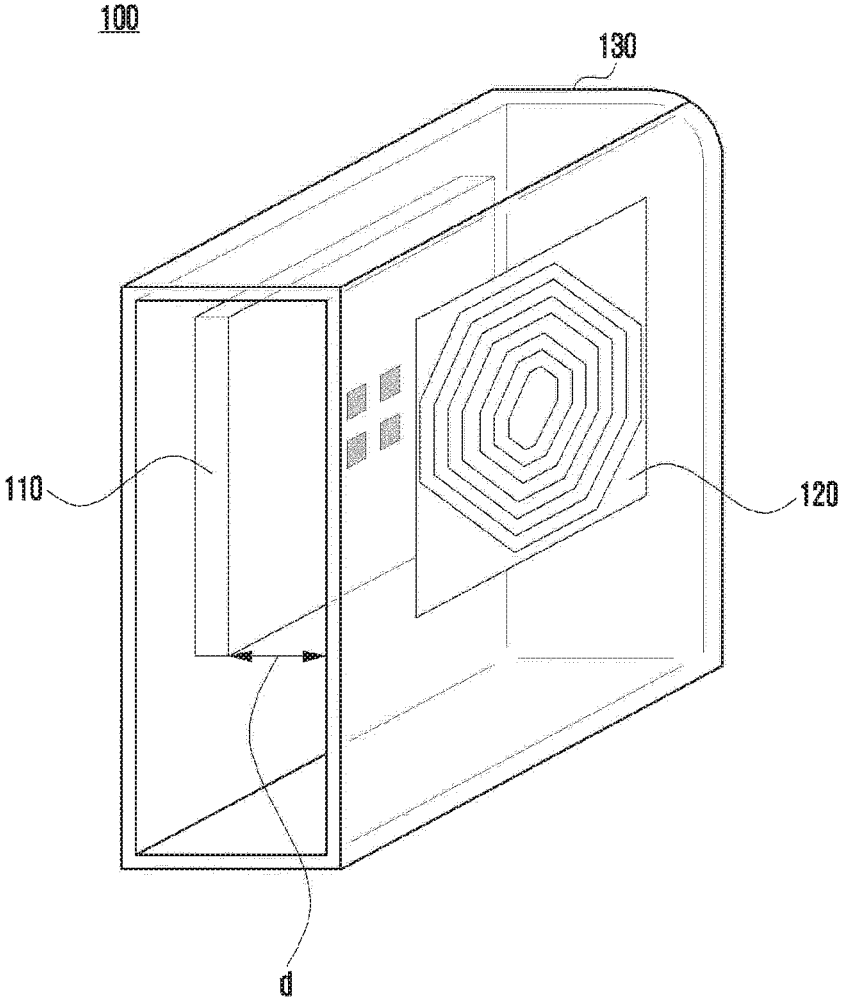
FIG. 1 is a perspective view showing an antenna module structure including a lens.

In the following description of embodiments, descriptions of techniques that are well known in the art and not directly related to the disclosure are omitted. This is to clearly convey the subject matter of the disclosure by omitting any unnecessary explanation.

For the same reason, some elements in the drawings are exaggerated, omitted, or schematically illustrated. Also, the size of each element does not entirely reflect the actual size. In the drawings, the same or corresponding elements are denoted by the same reference numerals.

The advantages and features of the disclosure and the manner of achieving them will become apparent with reference to embodiments described in detail below and with reference to the accompanying drawings. The disclosure may, however, be embodied in many different forms and should not be construed as being limited to the embodiments set forth herein. Rather, these embodiments are provided so that the disclosure will be thorough and complete and will fully convey the scope of the disclosure to those skilled in the art. To fully disclose the scope of the disclosure to those skilled in the art, the disclosure is only defined by the scope of claims. In the disclosure, similar reference numbers are used to indicate similar constituent elements.

It will be understood that each block of the flowchart illustrations, and combinations of blocks in the flowchart illustrations, may be implemented by computer program instructions. These computer program instructions may be provided to a processor of a general purpose computer, special purpose computer, or other programmable data processing apparatus to produce a machine, such that the instructions, which are executed via the processor of the computer or other programmable data processing apparatus, generate means for implementing the functions specified in the flowchart block or blocks. These computer program instructions may also be stored in a computer usable or computer-readable memory that may direct a computer or other programmable data processing apparatus to function in a particular manner, such that the instructions stored in the computer usable or computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that are executed on the computer or other programmable apparatus provide steps for implementing the functions specified in the flowchart block or blocks.

In addition, each block of the flowchart illustrations may represent a module, segment, or portion of code, which comprises one or more executable instructions for implementing the specified logical function(s). It should also be noted that in some alternative implementations, the functions noted in the blocks may occur out of the order. For example, two blocks shown in succession may in fact be executed substantially concurrently or the blocks may sometimes be executed in the reverse order, depending upon the functionality involved.

The term "unit", as used herein, refers to a software or hardware component or device, such as a field programmable gate array (FPGA) or application specific integrated circuit (ASIC), which performs certain tasks. A unit may be configured to reside on an addressable storage medium and configured to execute on one or more processors. Thus, a module or unit may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and units may be combined into fewer components and units or further separated into additional components and modules. In addition, the components and units may be implemented to operate one or more central processing units (CPUs) in a device or a secure multimedia card. Also, in embodiments, the unit may include one or more processors.

FIG. 1 is a perspective view showing an antenna module structure including a lens.

According to an embodiment, an antenna module 100 may include an antenna array 110 including a plurality of antenna elements, a lens 120 disposed to be spaced apart from the antenna array 110 by a predetermined distance, and a case 130 fixing the antenna array 110 and the lens 120.

According to an embodiment, the lens 120 may receive a beam radiated from the antenna array 110. The antenna array 110, which is used in the next generation mobile communication system, may radiate beams at various angles while changing the angle of the beam by using a beam sweeping function. The lens 120 may receive beams radiated in various phases, change the phases of the beams, and radiate the phase-changed beams to the outside of the case 130.

According to an embodiment, the lens 120 may improve the gain value of the antenna module 100. However, in order to improve the gain value, a separation distance (d) equal to or greater than a predetermined reference distance between the antenna array 110 and the lens 120 is required. For example, in the mmWave band used in the next generation mobile communication system, a separation distance (d) of 3 cm or more may be required.

However, in a recent trend of reduction in the size of an electronic device, an antenna module structure having a separation distance of several centimeters between the antenna and the lens is excluded. Therefore, an antenna module structure capable of reducing the separation distance between the antenna array 110 and the lens 120 is required. Described hereinafter is an antenna module structure for satisfying such a need.

Figure 2:
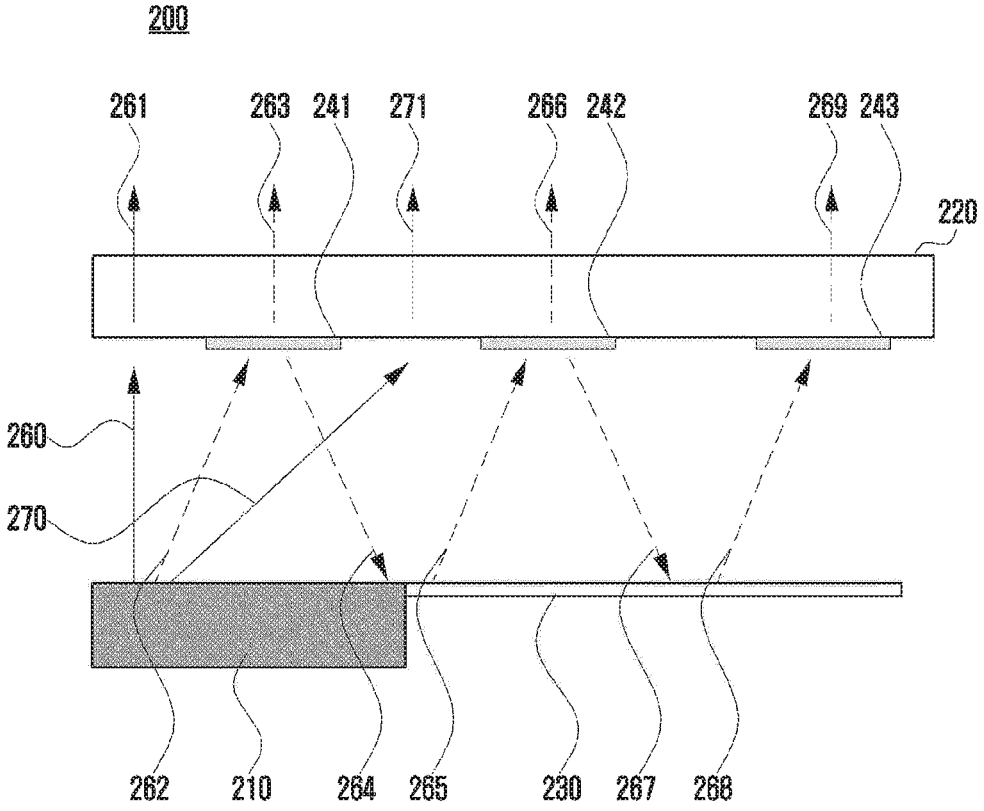
FIG. 2 is a side view showing an antenna module according to a first embodiment of the disclosure.

FIG. 2 is a side view showing an antenna module according to a first embodiment of the disclosure.

According to an embodiment, an antenna module 200 may include an antenna array 210 radiating a beam through a top surface thereof, a dielectric 220 disposed to be spaced apart from the top surface of the antenna array 210 by a first predetermined length, a first reflector 230 including a metallic material and disposed to be spaced apart from a bottom surface of the dielectric 220 by a second predetermined length, and second reflectors 241, 242, and 243 each including a metallic material and disposed in a partial region of the bottom surface of the dielectric 220, which faces the top surface of the antenna array 210.

According to an embodiment, the antenna array 210 may include a plurality of antenna elements. The antenna array 210 may perform beamforming by controlling the respective antenna elements. That is, the antenna array 210 may perform beam steering at various angles.

A plurality of beams 260, 262, and 270 may be radiated from the top surface of the antenna array 210. The beam 260 vertically radiated from the top surface of the antenna array 210 may be vertically incident on the bottom surface of the dielectric 220 disposed to be spaced apart from the antenna array 210 by the first length.

According to an embodiment, the beam 260 vertically incident on the bottom surface of the dielectric 220 may pass through the dielectric 220 without a change of a beam phase value. A beam 261 transmitted by passing through the dielectric 220 may be radiated outside the antenna module 200 while maintaining verticality to the dielectric 220.

According to an embodiment, by beamforming of the antenna array 210, the beam 270 having a specific phase value may be incident on the bottom surface of the dielectric 220. In this case, the dielectric 220 may change the phase of the beam 270, and a phase-changed beam 271 may be radiated outside the antenna module 200.

According to an embodiment, the beam 271 whose phase is changed by the dielectric 200 may have the same phase as the beam 261 radiated outside the antenna module 200 while maintaining verticality to the dielectric 220. Through this, the gain value of the antenna module 200 may be improved.

According to an embodiment, a certain beam 262 radiated from the antenna array 210 may be incident on the second reflector 241. The second reflector 241 includes a metallic material, and the beam incident on the second reflector 241 may partially reflect from the second reflector 241 thereby forming a reflected beam 264 having a phase changed by 180 degrees.

According to an embodiment, the beam incident on the second reflector 241 may partially pass through the second reflector 241 thereby forming a transmitted beam 263. The phase of the transmitted beam 263 may be changed by the dielectric 220 disposed on a top surface of the second reflector 241, and the phase-changed beam 263 may be radiated outside the antenna module 200.

According to an embodiment, the beam 263 whose phase is changed may have the same phase as the beams 261 and 271 radiated outside the antenna module 200 while maintaining verticality to the dielectric 220. Through this, the gain value of the antenna module 200 may be improved.

According to an embodiment, the beam 264 reflecting from the second reflector 241 has a specific phase and may be incident on the first reflector 230. The beam 264 incident on the first reflector 230 may not pass through the first reflector 230 and may totally reflect from the first reflector 230 while having a phase changed by 180 degrees.

According to an embodiment, a beam 265 reflected by the first reflector 230 may have the same phase as the specific beam 262 and may be incident on the second reflector 242. The second reflector 242 includes a metallic material, and the beam incident on the second reflector 242 may partially reflect from the second reflector 242 thereby forming a reflected beam 267 having a phase changed by 180 degrees.

According to an embodiment, the beam incident on the second reflector 242 may partially pass through the second reflector 242 thereby forming a transmitted beam 266. The phase of the transmitted beam 266 may be changed by the dielectric 220 disposed on the top surface of the second reflector 242, and the phase-changed beam 266 may be radiated outside the antenna module 200.

According to an embodiment, the beam 266 whose phase is changed may have the same phase as the beams 261, 263, and 271 radiated outside the antenna module 200 while maintaining verticality to the dielectric 220. Through this, the gain value of the antenna module 200 may be improved.

According to an embodiment, the beam 267 reflecting from the second reflector 242 has a specific phase and may be incident on the first reflector 230. The beam 267 incident on the first reflector 230 may not pass through the first reflector 230 and may totally reflect from the first reflector 230 while having a phase changed by 180 degrees.

According to an embodiment, a beam 268 reflected by the first reflector 230 may have the same phase as the specific beams 262 and 265 and may be incident on the second reflector 243. According to an embodiment, the beam incident on the second reflector 243 may be partially radiated outside the antenna module 200 while forming a beam 269 having a phase changed by the dielectric 220.

According to an embodiment, the beam 269 whose phase is changed may have the same phase as the specific beams 261, 263, 266, and 271 radiated outside the antenna module 200 while maintaining verticality to the dielectric 220. Through this, the gain value of the antenna module 200 may be improved.

Although not shown, the beam 268 incident on the second reflector 243 may also partially reflect toward the first reflector 230 with a phase changed by 180 degrees. That is, some of the beams radiated from the antenna array 210 may move inside the antenna module 200 while reflecting from the first reflector 230 and the second reflectors 241, 242, and 243, and may be radiated to the outside of the antenna module 200.

Therefore, according to an embodiment of the disclosure, the area of radiating the beam through the dielectric 220 can be widened, so that the performance (e.g., a gain value) of the antenna module can be improved.

According to an embodiment, the first reflector 230 may be disposed to surround the antenna array 210 on a horizontal plane on which the antenna array 210 is disposed. That is, a first length which is a separation distance between the antenna array 210 and the dielectric 220 may be equal to a second length which is a separation distance between the dielectric 220 and the first reflector 230.

According to an embodiment, the first length, which is the separation distance between the antenna array 210 and the dielectric 220, may be shorter than or equal to the second length, which is the separation distance between the dielectric 220 and the first reflector 230. According to an embodiment, the antenna array 210 may be disposed on a top surface of a printed circuit board (PCB). According to an embodiment, the antenna array 210 may be a patch type antenna.

According to an embodiment, the first reflector 230 may be formed by extending from a ground layer disposed on a bottom surface of the PCB. That is, the first reflector 230 may be disposed to surround the antenna array 210 on a horizontal plane on which the ground layer is disposed. According to an embodiment, the first reflector 230 and the ground layer may be electrically connected to each other.

Meanwhile, the embodiment shown in FIG. 2 is exemplary only for implementing the disclosure. Accordingly, the scope of the disclosure should not be limited to the embodiment shown in FIG. 2.

Figure 3:
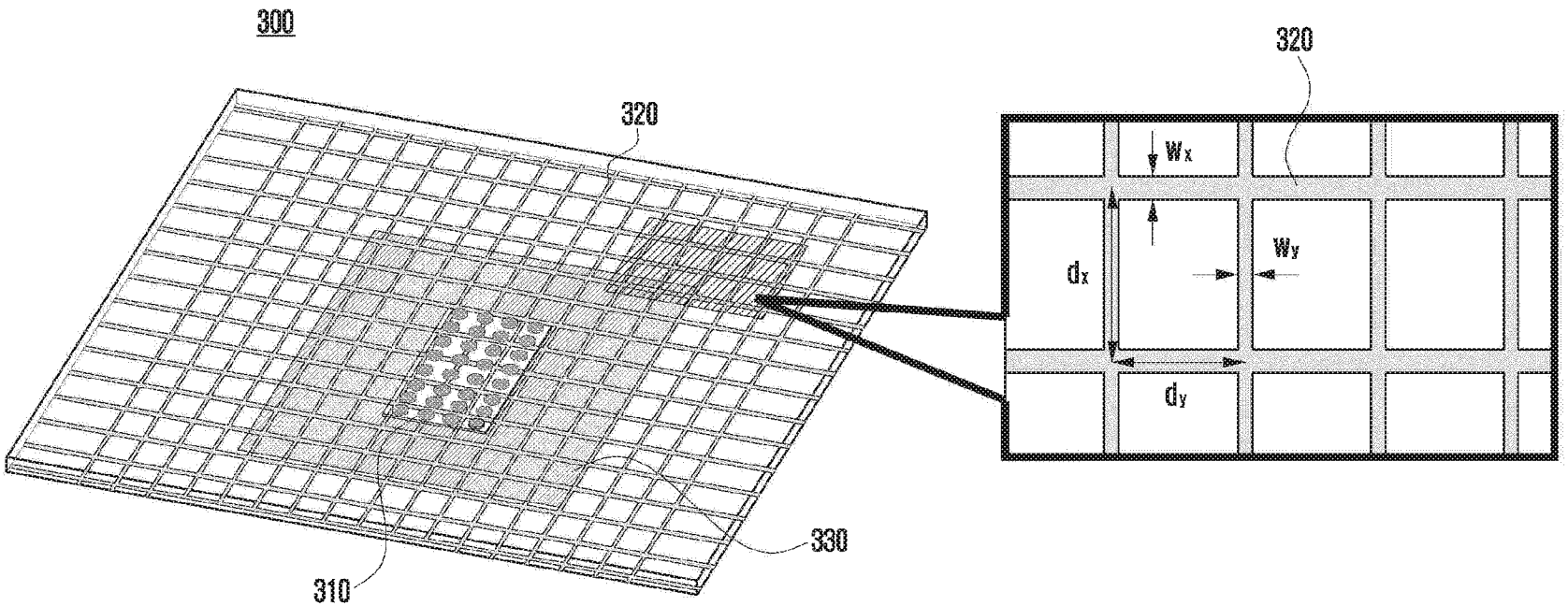
FIG. 3 is a view showing a top surface of an antenna module according to the first embodiment of the disclosure.

FIG. 3 is a view showing a top surface of an antenna module according to the first embodiment of the disclosure.

According to an embodiment, a second reflector 320 may have a grid shape. That is, an edge of a grid pattern may be composed of the second reflector 320, and the second reflector 320 may be disposed on a bottom surface of a dielectric (not shown) having a plate shape. Through the grid-shaped second reflector 320, a region of the bottom surface of the dielectric where the edge of the grid pattern is disposed may be used as a reflector, and the other region of the bottom surface of the dielectric where the edge of the grid pattern is not disposed may be used as a dielectric.

According to an embodiment, the second reflector 320 may be disposed to face a top surface of an antenna array 310, and the antenna array 310 may be disposed to be spaced apart from the second reflector 320 by a predetermined length. According to an embodiment, a first reflector 330 may be disposed around the antenna array 310 such that a beam radiated from the antenna array 310 and then reflecting from the second reflector 320 can reflect again toward the second reflector 320.

According to an embodiment, the first reflector 330 may contain a metallic material in order to reflect, toward the second reflector 320, all of beams reflected by the second reflector 320. According to an embodiment, the first reflector 330 may be disposed to surround the antenna array 310 on a horizontal plane on which the antenna array 310 is disposed. That is, a separation distance between the antenna array 310 and the second reflector 320 may be equal to a separation distance between the first reflector 330 and the second reflector 320.

According to an embodiment, each grid pattern forming the second reflector 320 may have a rectangular shape. (Specifically, $d_x$ and $d_y$ shown in FIG. 3 may be different from each other.) In addition, sizes of the respective grid patterns may be different from each other. (Specifically, $w_x$ and $w_y$ shown in FIG. 3 may be different from each other.)

According to an embodiment, each grid pattern forming the grid-shaped second reflector 320 may be asymmetric. According to an embodiment, through the asymmetric grid-shaped second reflector 320, a gain value of a specific phase (e.g., a phase of a beam to be radiated from the antenna module) may be improved.

Meanwhile, the embodiment shown in FIG. 3 is exemplary only for implementing the disclosure. Accordingly, the scope of the disclosure should not be limited to the embodiment shown in FIG. 3. For example, the second reflector 320 may have a hexagon grid shape, not a grid shape having a grid pattern.

Figure 4:
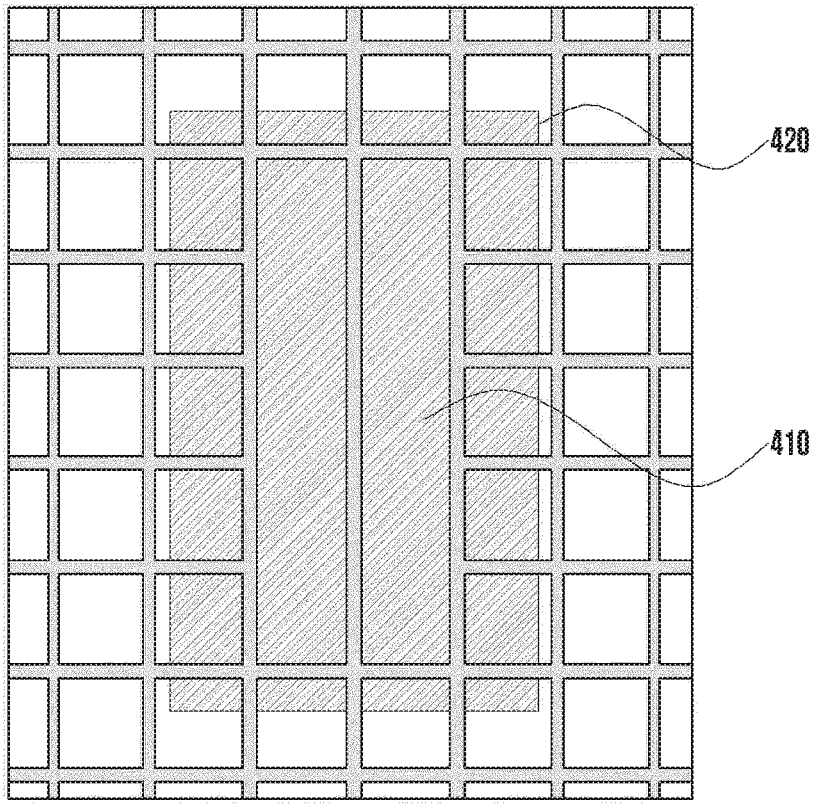
FIG. 4 is a view showing a top surface of an antenna module according to a second embodiment of the disclosure.

FIG. 4 is a view showing a top surface of an antenna module according to a second embodiment of the disclosure.

According to an embodiment, each grid pattern forming a second reflector 420 having a grid shape may be non-uniform. According to an embodiment, when the antenna module is viewed from above, the size of a grid pattern of the second reflector 420 overlapped with an antenna array 410 may be greater than the size of a grid pattern of the second reflector 420 not overlapped with the antenna array 410.

According to an embodiment, when the antenna module is viewed from above, a region overlapped with the antenna array 410 is likely to be a beam radiated perpendicularly to the antenna array 410. Therefore, as shown in FIG. 4, it is desirable to minimize the arrangement of the second reflector in the above region in terms of improving the gain value of the antenna module.

Figure 5:
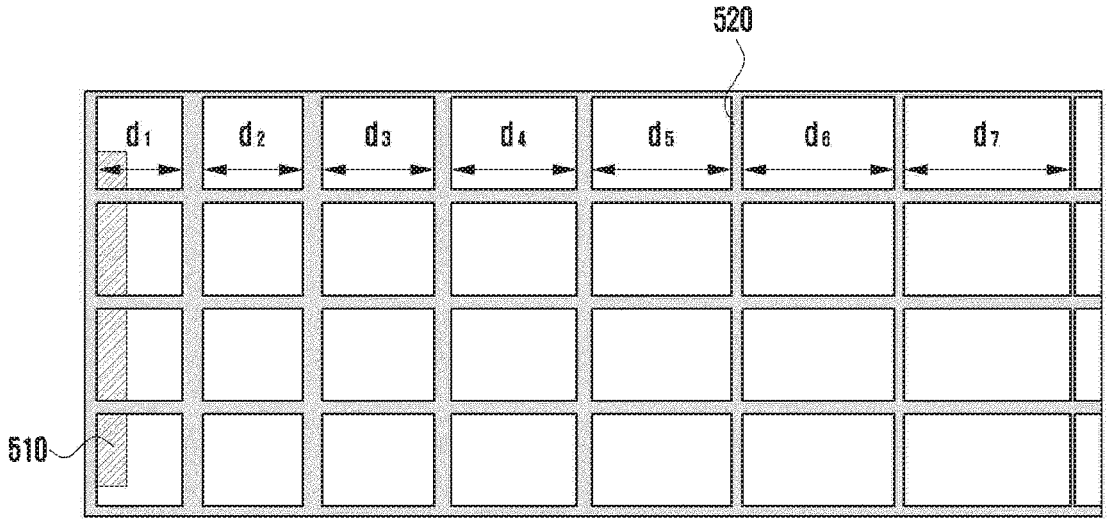
FIG. 5 is a view showing a top surface of an antenna module according to a third embodiment of the disclosure.

FIG. 5 is a view showing a top surface of an antenna module according to a third embodiment of the disclosure.

According to an embodiment, each grid pattern forming a second reflector 520 having a grid shape may be non-uniform. According to an embodiment, when the antenna module is viewed from above, the size of each grid pattern may increase as each grid pattern is further away from the central axis of an antenna array 510.

According to an embodiment, the base length of a grid pattern located closest to the antenna array 510 is $d_1$, and the base length of a grid pattern located next to the grid pattern having the base length $d_1$ is $d_2$. Here, $d_2$ may be greater than $d_1$. In the same manner, the relationship between the base lengths of the grid patterns shown in FIG. 5 is as follows.

$$d_1<d_2<d_3<d_4<d_5<d_6<d_7 \quad \text{(Equation)}$$

$d_1$, $d_2$, $d_3$, $d_4$, $d_5$, $d_6$, $d_7$: Base length of grid pattern

According to an embodiment, a gain value of a specific phase (e.g., a phase of a beam to be radiated from an antenna module) may be improved through the second reflector 520 having such a non-uniform grid shape.

Figure 6A:
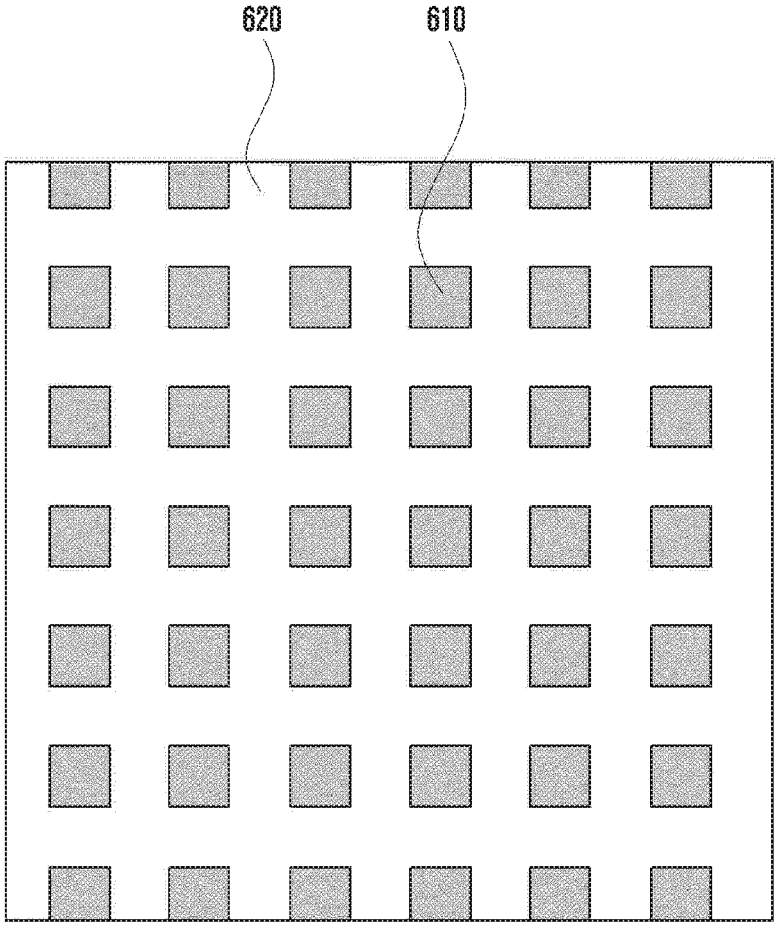
FIGS. 6A to 6D are views showing shapes of a second reflector according to embodiments of the disclosure.

FIG. 6A is a view showing a shape of a second reflector according to an embodiment of the disclosure.

According to an embodiment, the second reflector 610 may include a plurality of unit reflectors each having a square shape, and the plurality of unit reflectors may be periodically disposed on a bottom surface of a dielectric 620. That is, the unit reflectors may be repeatedly disposed on the bottom surface of the dielectric 620 while being spaced apart from each other by the same distance.

According to an embodiment, some of beams radiated from an antenna array may be reflected by the second reflector 610 with a phase changed by 180 degrees, and the others of the beams may be radiated outside the antenna module while passing through the dielectric 620. According to an embodiment, the transmitted beams passing through the dielectric 620 may have phases changed by the dielectric 620.

Figure 6B:
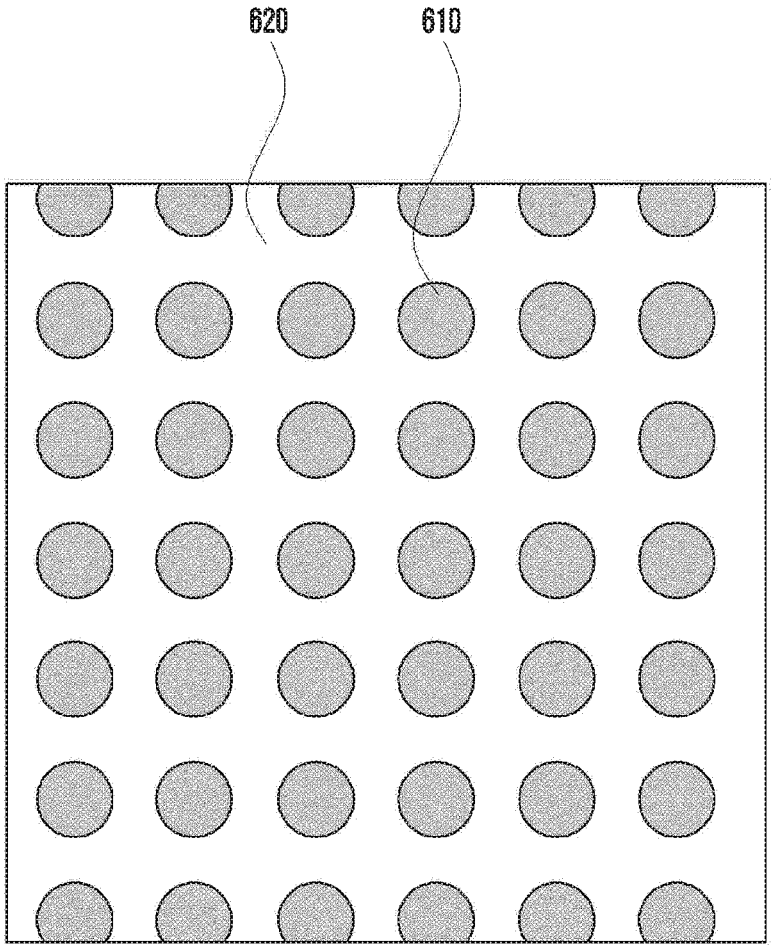

FIG. 6B is a view showing a shape of a second reflector according to an embodiment of the disclosure.

According to an embodiment, the second reflector 610 may include a plurality of unit reflectors each having a circular shape, and the plurality of unit reflectors may be periodically disposed on the bottom surface of the dielectric 620. That is, the unit reflectors may be repeatedly disposed on the bottom surface of the dielectric 620 while being spaced apart from each other by the same distance.

Excepting that the unit reflector is formed in a circular shape, the structures and effects of the second reflector and the dielectric may be the same as or similar to those of the second reflector and the dielectric shown in FIG. 6A.

Figure 6C:
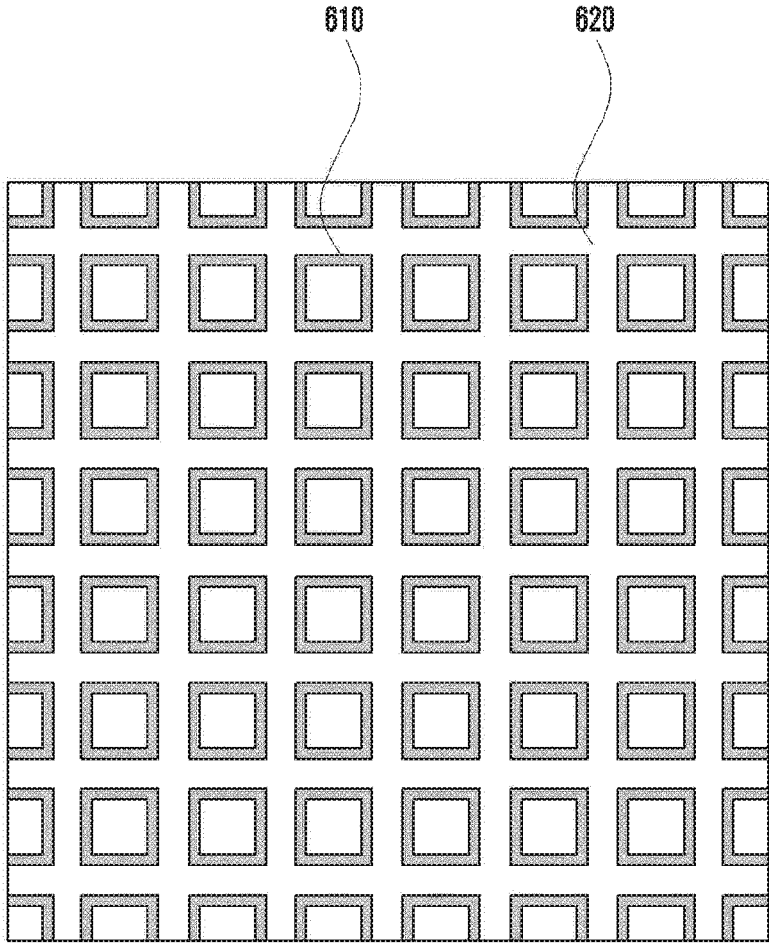

FIG. 6C is a view showing a shape of a second reflector according to an embodiment of the disclosure.

According to an embodiment, the second reflector 610 may include a plurality of unit reflectors each having a square ring shape, and the plurality of unit reflectors may be periodically disposed on the bottom surface of the dielectric 620. That is, the unit reflectors may be repeatedly disposed on the bottom surface of the dielectric 620 while being spaced apart from each other by the same distance.

Excepting that the unit reflector is formed in a square ring shape, the structures and effects of the second reflector and the dielectric may be the same as or similar to those of the second reflector and the dielectric shown in FIG. 6A.

Figure 6D:
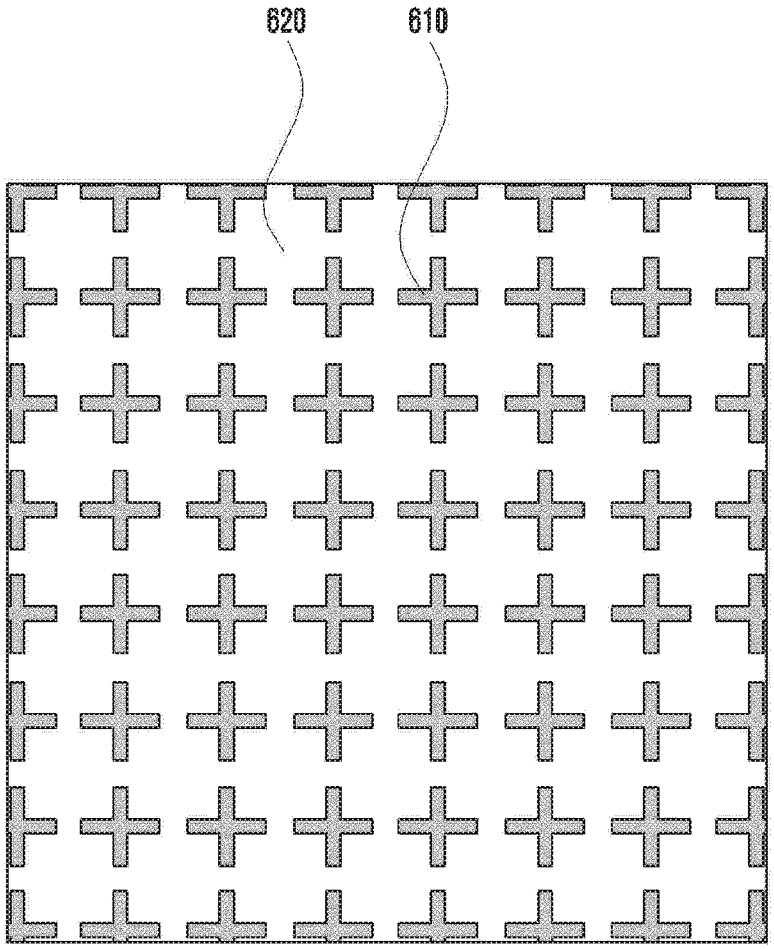

FIG. 6D is a view showing a shape of a second reflector according to an embodiment of the disclosure.

According to an embodiment, the second reflector 610 may include a plurality of unit reflectors each having a cross shape, and the plurality of unit reflectors may be periodically disposed on the bottom surface of the dielectric 620. That is, the unit reflectors may be repeatedly disposed on the bottom surface of the dielectric 620 while being spaced apart from each other by the same distance.

Excepting that the unit reflector is formed in a cross shape, the structures and effects of the second reflector and the dielectric may be the same as or similar to those of the second reflector and the dielectric shown in FIG. 6A.

Figure 7:
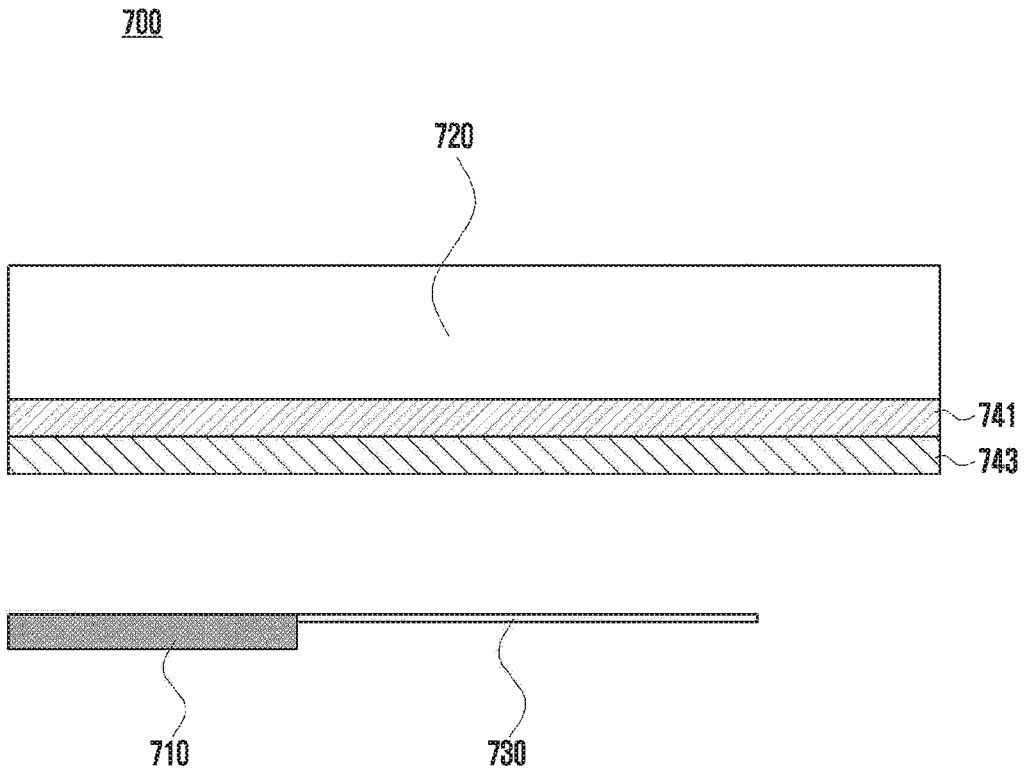
FIG. 7 is a side view showing an antenna module according to a fourth embodiment of the disclosure.

FIG. 7 is a side view showing an antenna module according to a fourth embodiment of the disclosure.

According to an embodiment, the antenna module 700 may include an antenna array 710 radiating a beam through a top surface thereof, a dielectric 720 disposed to be spaced apart from the top surface of the antenna array 710 by a first predetermined length, and a first reflector 730 including a metallic material and disposed to be spaced apart from a bottom surface of the dielectric 720 by a second predetermined length.

According to an embodiment, the antenna module 700 may include a second reflector including a metallic material and disposed in a partial region of the bottom surface of the dielectric, which faces the top surface of the antenna array. The second reflector may include a plurality of layers 741 and 743.

According to an embodiment, the respective layers 741 and 743 constituting the second reflector may be formed of periodically disposed unit reflectors having different shapes. For example, a reflector having a grid shape may be disposed in the layer 741, and a reflector composed of periodically disposed unit reflectors having a square shape may be disposed in the layer 743.

According to an embodiment, the respective layers 741 and 743 constituting the second reflector may be formed of periodically disposed unit reflectors having the same shape. For example, if the layer 741 is a reflector composed of periodically disposed unit reflectors having a circular shape, the layer 743 may also be a reflector composed of periodically disposed unit reflectors having a circular shape.

Figure 8:
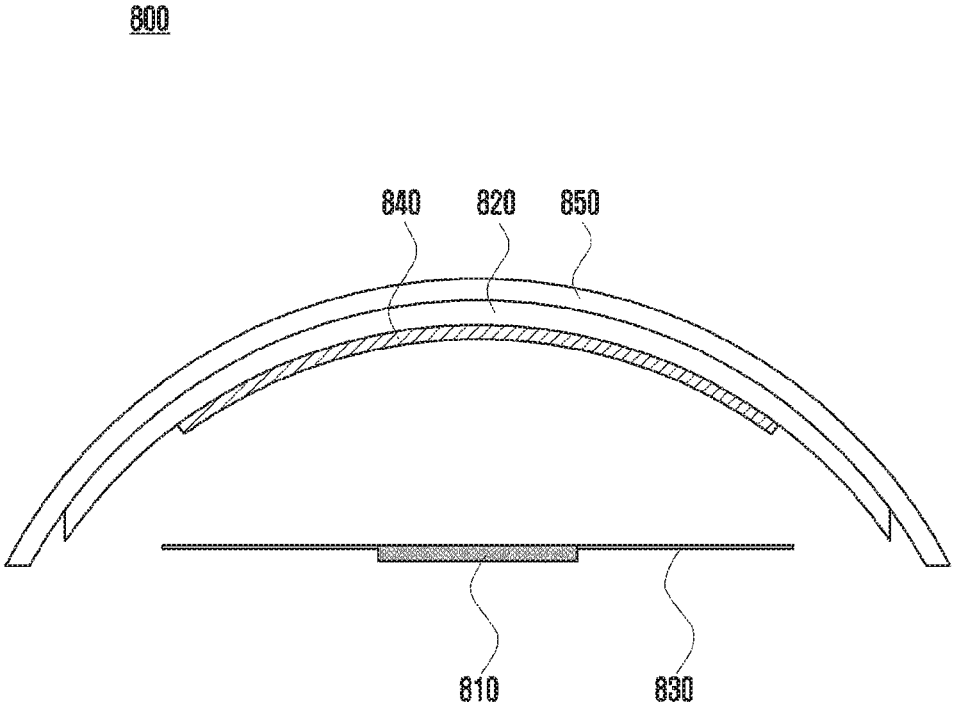
FIG. 8 is a side view showing an electronic device according to an embodiment of the disclosure.

FIG. 8 is a side view showing an electronic device according to an embodiment of the disclosure.

According to an embodiment, the electronic device 800 may include an antenna module and a housing 850 formed to surround the antenna module. The antenna module may include an antenna array 810 radiating a beam through a top surface thereof, a dielectric 820 disposed to be spaced apart from the top surface of the antenna array 810 by a first predetermined length, a first reflector 830 including a metallic material and disposed to be spaced apart from a bottom surface of the dielectric 820 by a second predetermined length, and a second reflector 830 including a metallic material and disposed in a partial region of the bottom surface of the dielectric 820, which faces the top surface of the antenna array 810.

According to an embodiment, the dielectric 820 and the second reflector 840 may be disposed on one surface of the housing 850 along the outer periphery of the housing 850. That is, when the housing 850 is formed with a curved surface, the dielectric 820 and the second reflector 840 may also be formed with a curved surface.

According to an embodiment, the dielectric 820 and the second reflector 840 may be printed on one surface of the housing. According to an embodiment, the second reflector 840 may be disposed on the dielectric 820 through a patterning process.

While the disclosure has been described in detail with reference to specific embodiments, it is to be understood that various changes and modifications may be made without departing from the scope of the disclosure. In addition, the above-described embodiments may be selectively combined with each other if necessary. For example, some of the embodiments proposed in the disclosure may be combined with each other and used by a base station and a terminal.

The invention claimed is:

1. An antenna module comprising:

an antenna array configured to radiate a beam through a top surface of the antenna array;

a dielectric disposed to be spaced apart from the top surface of the antenna array by a first predetermined length;

a first reflector including a metallic material and disposed to be spaced apart from a bottom surface of the dielectric by a second predetermined length;

a second reflector including a metallic material and disposed in a partial region of the bottom surface of the dielectric, which faces the top surface of the antenna array; and a housing for fixing the antenna array and the dielectric, wherein the second reflector has a grid shape composed of a plurality of grid patterns, and a grid pattern overlapped with the antenna array among the plurality of grid patterns has a larger size than a grid pattern not overlapped with the antenna array among the plurality of grid patterns, wherein the dielectric and the second reflector are disposed on a surface of the housing along an outer periphery of the housing, and wherein the housing, the second reflector, and the dielectric are formed to have a curved shape.

2. The antenna module of claim 1, wherein the dielectric changes a phase of a beam incident through the bottom surface of the dielectric and radiates the beam through a top surface of the dielectric.

3. The antenna module of claim 1, wherein the first reflector is disposed to surround the antenna array on a horizontal plane on which the antenna array is disposed.

4. The antenna module of claim 1, wherein the first predetermined length is shorter than or equal to the second predetermined length.

5. The antenna module of claim 1, wherein the second reflector is disposed on the dielectric through a patterning process.

6. The antenna module of claim 1, wherein the second reflector includes a plurality of unit reflectors having a predetermined shape, the plurality of unit reflectors are periodically disposed on the bottom surface of the dielectric, and the predetermined shape includes at least one of a square shape, a circular shape, a square ring shape, or a cross shape.

7. The antenna module of claim 1, wherein the second reflector is composed of a plurality of layers.

8. An electronic device comprising:

an antenna module, wherein the antenna module includes:

an antenna array configured to radiate a beam through a top surface of the antenna array;

a dielectric disposed to be spaced apart from the top surface of the antenna array by a first predetermined length;

a first reflector including a metallic material and disposed to be spaced apart from a bottom surface of the dielectric by a second predetermined length;

a second reflector including a metallic material and disposed in a partial region of the bottom surface of the dielectric, which faces the top surface of the antenna array; and a housing for fixing the antenna array and the dielectric, wherein the second reflector has a grid shape composed of a plurality of grid patterns, and a grid pattern overlapped with the antenna array among the plurality of grid patterns has a larger size than a grid pattern not overlapped with the antenna array among the plurality of grid patterns, wherein the dielectric and the second reflector are disposed on a surface of the housing along an outer periphery of the housing, and wherein the housing, the second reflector, and the dielectric are formed to have a curved shape.

9. The electronic device of claim 8, wherein the dielectric changes a phase of a beam incident through the bottom surface of the dielectric and radiates the beam through a top surface of the dielectric.

10. The electronic device of claim 8, wherein the first reflector is disposed to surround the antenna array on a horizontal plane on which the antenna array is disposed.

11. The electronic device of claim 8, wherein the first predetermined length is shorter than or equal to the second predetermined length.

12. The electronic device of claim 8, wherein the second reflector is disposed on the dielectric through a patterning process.

13. The electronic device of claim 8, wherein the second reflector includes a plurality of unit reflectors having a predetermined shape, the plurality of unit reflectors are periodically disposed on the bottom surface of the dielectric, and the predetermined shape includes at least one of a square shape, a circular shape, a square ring shape, or a cross shape.

* * * * *